US007191634B1

(12) United States Patent
Borgos, III

(10) Patent No.: US 7,191,634 B1
(45) Date of Patent: Mar. 20, 2007

(54) METHOD AND APPARATUS FOR DENT REPAIR

(76) Inventor: Cesar A. Borgos, III, 104 Addington Pl., Madison, MS (US) 39110

( * ) Notice: Subject to any disclaimer, the term of this patent is extended or adjusted under 35 U.S.C. 154(b) by 0 days.

(21) Appl. No.: 11/334,827

(22) Filed: Jan. 19, 2006

Related U.S. Application Data

(60) Provisional application No. 60/645,393, filed on Jan. 19, 2005.

(51) Int. Cl.
*B25B 7/00* (2006.01)

(52) U.S. Cl. ..... 72/409.01; 72/409.1; 72/705

(58) Field of Classification Search ..... 72/392, 72/409.01, 409.09, 409.1, 409.11, 409.17, 72/457, 458, 705
See application file for complete search history.

(56) References Cited

U.S. PATENT DOCUMENTS 4,914,942 A * 4/1990 Ishihara ..... 72/463
4,930,335 A * 6/1990 Ishihara ..... 72/451
5,203,196 A * 4/1993 Jenkins ..... 72/391.2
5,473,928 A * 12/1995 Teitzel ..... 72/457
6,536,250 B1 * 3/2003 Borchert ..... 72/37

* cited by examiner

*Primary Examiner*—Ed Tolan
(74) *Attorney, Agent, or Firm*—Carr LLP

(57) ABSTRACT

A unique tool for removing dents from sheet metal that is best accessed or can only be accessed from the same side of the metal surface from which the dent was originally created. The tool has a lower plate and an upper plate. The lower plate has a lower side proximate to a dent in a surface to be repaired and an upper side. The upper plate has a lower side proximate to the upper side of the lower plate and an upper side. The tool has a plurality of pins slidably extending through the lower and upper plates, the pins having heads proximate to said upper side of said upper plate and lower attachment ends adapted for receiving an adhesive. The tool further has a displacing member for selectively displacing the upper plate away from the lower plate so that the upper side of the upper plate will push the heads of the pins upwardly as the upper plate is displaced, causing the lower attachment ends to move upwardly. The tool can have two handles that pivot around a pin so that when squeezed together the opposite ends move towards each other by means of wedge-shaped pieces.

22 Claims, 4 Drawing Sheets

METHOD AND APPARATUS FOR DENT REPAIR

RELATED APPLICATIONS

This application claims the benefit of priority of U.S. Provisional Application No. 60/645,393, filed Jan. 19, 2005.

BACKGROUND OF THE INVENTION

The present invention relates to removal of dents from sheet material, especially sheet metal. A typical use is for paint-less dent repair of automobile painted panels with dents that were created by impact or pushing of the metal by a semi-round object such as hail.

SUMMARY OF THE INVENTION

The present invention provides a unique tool and method for removing dents from sheet metal that is best accessed or can only be accessed from the same side of the metal surface from which the dent was originally created. The tool can also be used on any sheet metal surface having similar properties to typical automobile body panels.

In one embodiment of the present invention, a dent removal tool is provided comprising a lower plate and an upper plate. The lower plate has a lower side proximate to a dent in a surface to be repaired and an upper side. The upper plate has a lower side proximate to the upper side of the lower plate and an upper side. The tool has a plurality of pins slidably extending through the lower and upper plates, the pins having heads proximate to said upper side of said upper plate and lower attachment ends adapted for receiving an adhesive. The tool further has a displacing member for selectively displacing the upper plate away from the lower plate so that the upper side of the upper plate will push the heads of the pins upwardly as the upper plate is displaced, causing the lower attachment ends to move upwardly.

BRIEF DESCRIPTION OF THE DRAWINGS

FIG. 10 depicts a top view of a typical prior art paint-less dent removal tool depicted in FIG. 11, as attached to.

DETAILED DESCRIPTION

Figure 10:
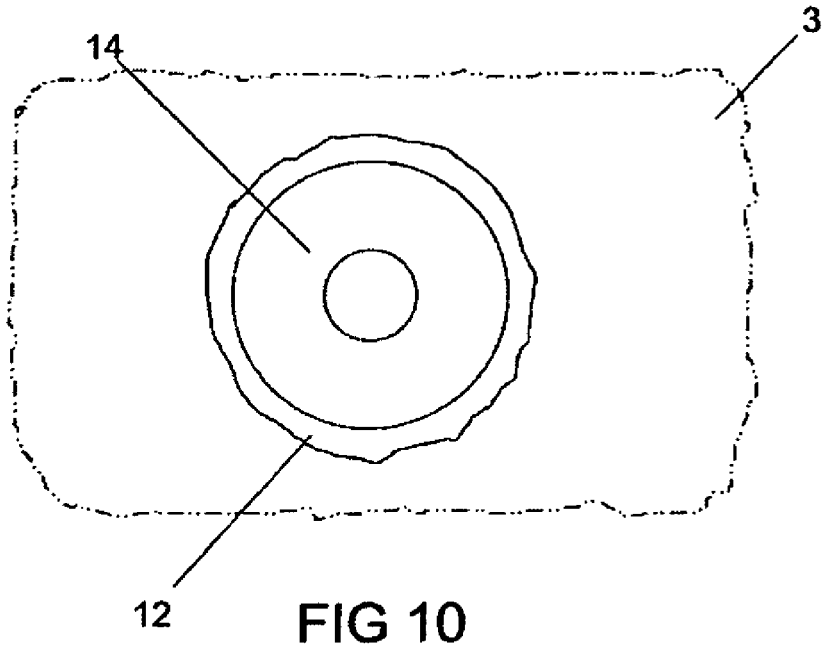
Figure 11:
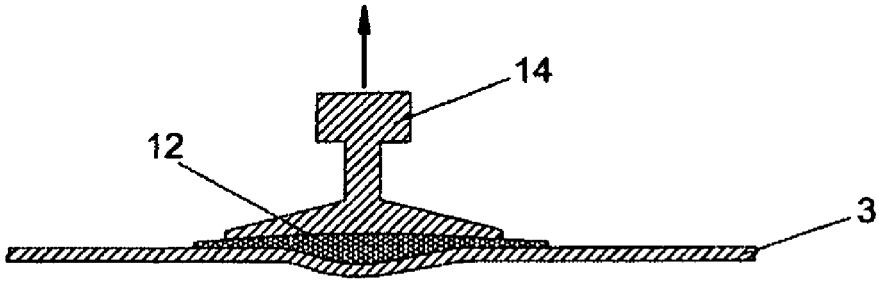
FIG 11 PRIOR ART
FIG. 11 depicts a side cross-sectional view of the prior art paint-less dent removal tool of the prior art as shown in FIG. 10.

Referring now to the drawings in detail, and initially to FIGS. 10 and 111 thereof, the present typical prior art method of removal of a semi-round dent (such as caused by hail, for example), using a typical tool, is depicted. In this method using this tool, an adhesive (12) is applied over the dent between an attachment (14) and a sheet metal panel surface (3) to provide a gripping surface or mechanical attachment for a pulling device such as a slide hammer (not shown) to be applied to the tool. A large amount of force and the skill to know the extent of force to be applied is required to pull the dent even to the original surface (3). Frequently several attachments are made before the desired results are achieved. If too much force is used and the attachment (14) does not release, the resulting reversed dent created is more difficult to remove than the original dent. If the attachment (14) does not pull away from the metal surface (3) a release agent is used to release the attachment (14) from the metal surface (3). The desired result leaves a dimple that is then tapped back down to leave a smooth surface. Release agent is used to clean any remaining adhesive (12) from the surface.

Figure 3:
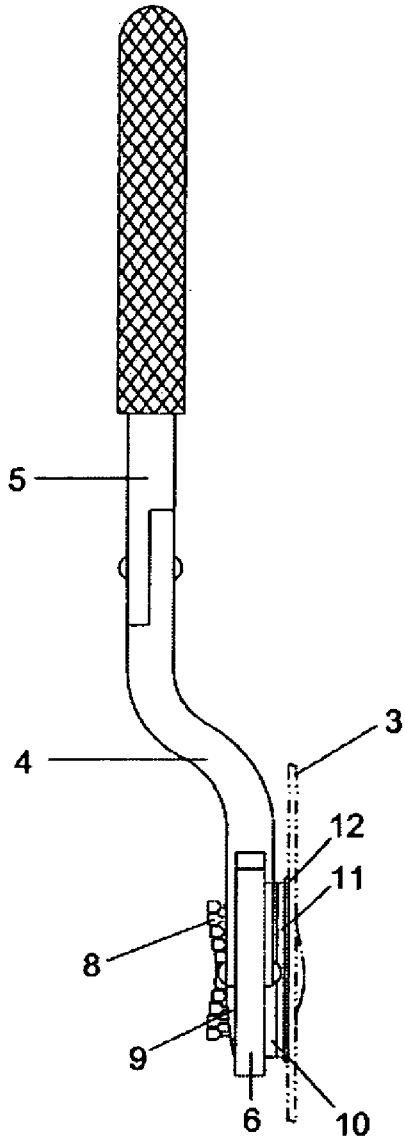
FIG. 3 depicts a side view of the tool depicted in FIG. 1.
Figure 1:
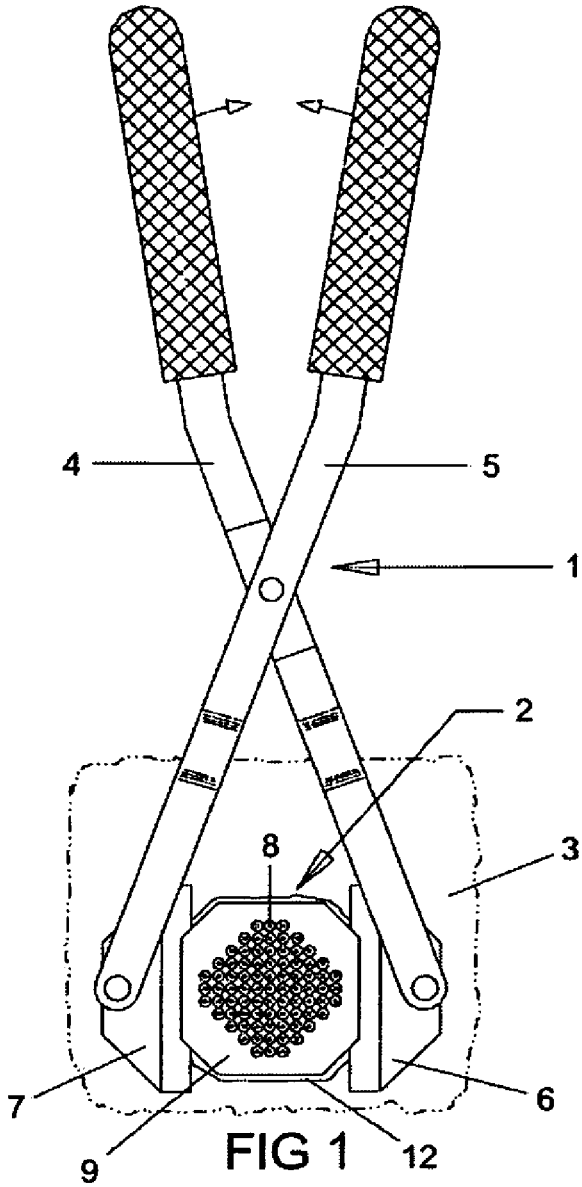
FIG. 1 depicts a top view of a tool in accordance with one embodiment of the present invention, in use on a dent in sheet metal.
Figure 2:
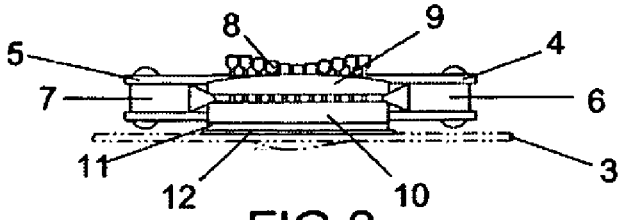
FIG. 2 depicts an end view of the tool depicted in FIG. 1.

Referring now to FIGS. 1–9, a dent pulling apparatus in accordance with one embodiment of the present invention is depicted. FIG. 1 is a top view, FIG. 2 is and end view and FIG. 3 is a side view of the dent puller tool (1) and dent puller assembly (2). In this embodiment, the dent pulling tool (1) is a scissors arrangement of two handles (4) and (5) that pivot around a pin so that when squeezed together the opposite ends move towards each other. The dent puller assembly (2) is attached to the opposite ends of the handles with pins to have a scissors action. Dent puller assembly (2) functions as the working end of the tool (1) and includes wedge-shaped pieces (6) and (7) that act as camming surfaces for displacing the top plate (9) away from bottom plate (10).

Changing the size of the dent puller assembly (2), using the same configuration, allows for dents of different sizes and types to be pulled.

As noted above, the dent puller assembly (2) further includes a top plate (9). Top plate (9) can conveniently be square with beveled corners with a flat surface on the bottom and a conical convex surface, radiating from the center of the top surface down towards the outside edges of the top plate (9). The shape of the conical surface will vary according to the size and type of dent to be pulled.

The bottom plate (10) is square and the same size with beveled corners as the top plate (9). The top surface is flat and the bottom surface is conical concaved, radiating from the center down to the outer edges, similar in shape to the convex surface of the top surface of the top plate (9). The shape of the concaved surface will vary according to the size and type of dent to be pulled.

Inserted through the top plate (9) and the bottom plate (10) are multiple small pins (8) in straight rows that are free to move in both plates. Short lengths of the top of the pins (8) are of a larger diameter than the holes in the top plate to prevent the pins (8) from moving completely through the top plate. Short lengths of the bottom of the pins (8) are a larger diameter than the shaft that fits through the top (9) and bottom (10) plates. The bottoms of the pins (8) are embedded in a flexible material (11) such that they will not pull loose when force is applied. The number of pins (8), rows, and length of rows will vary according to the size and type of dent to be pulled.

The pulling of dents is accomplished by using an adhesive (12) to adhere the flexible material (11) on the bottom of the pins to the dent in the sheet metal (3). The pins (8) are pushed down to conform to the shape of the dent as shown in FIG. 5.

Figure 4:
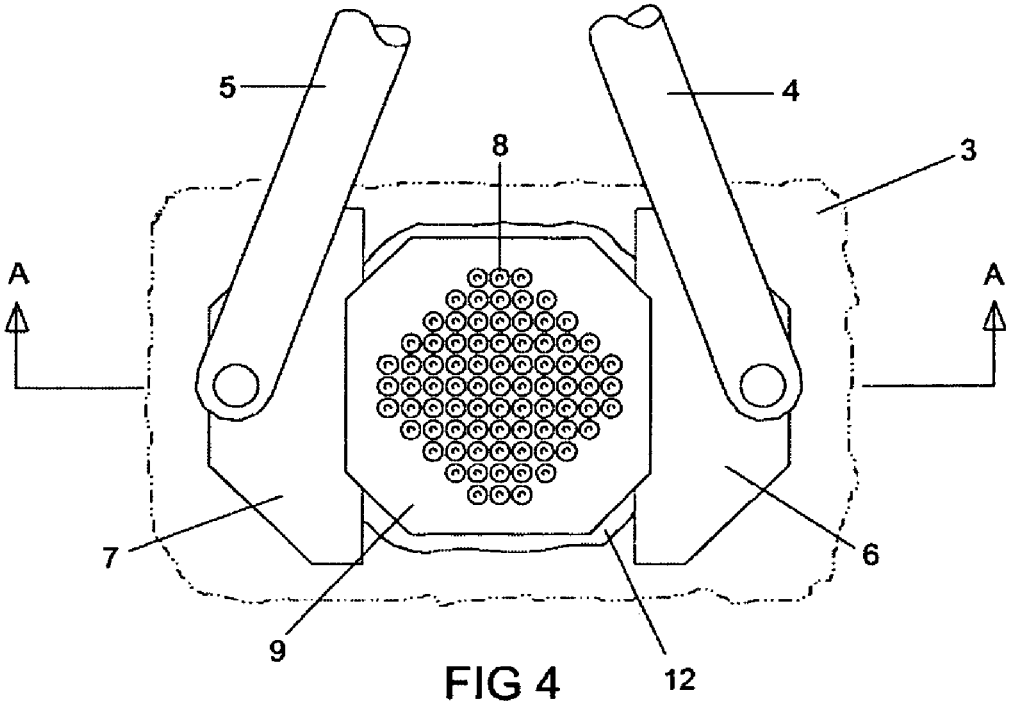
FIG. 4 depicts an enlarged view of the working end of the tool depicted in FIG. 1.
Figure 5:
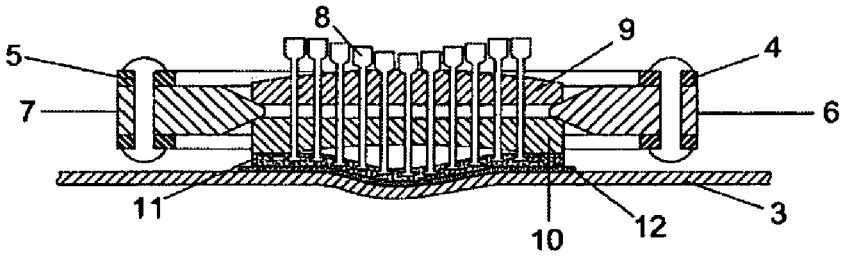
FIG. 5 depicts an end cross-sectional view of the working end of the tool depicted in FIG. 1, with adhesive adhering the attachment ends of slidable pins to the surface of the sheet metal having a dent, just prior to removal of the dent.
Figure 6:
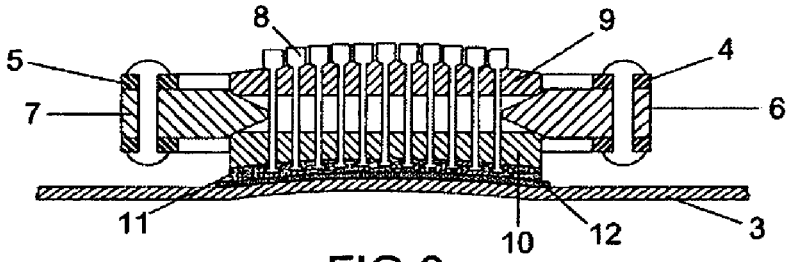
FIG. 6 depicts an end cross-sectional view of the working end of the tool depicted in FIG. 1, with the attachment ends of slidable pins adhered to the surface of the sheet metal having a dent, just after pulling out of the dent to a somewhat convex curve.
Figure 7:
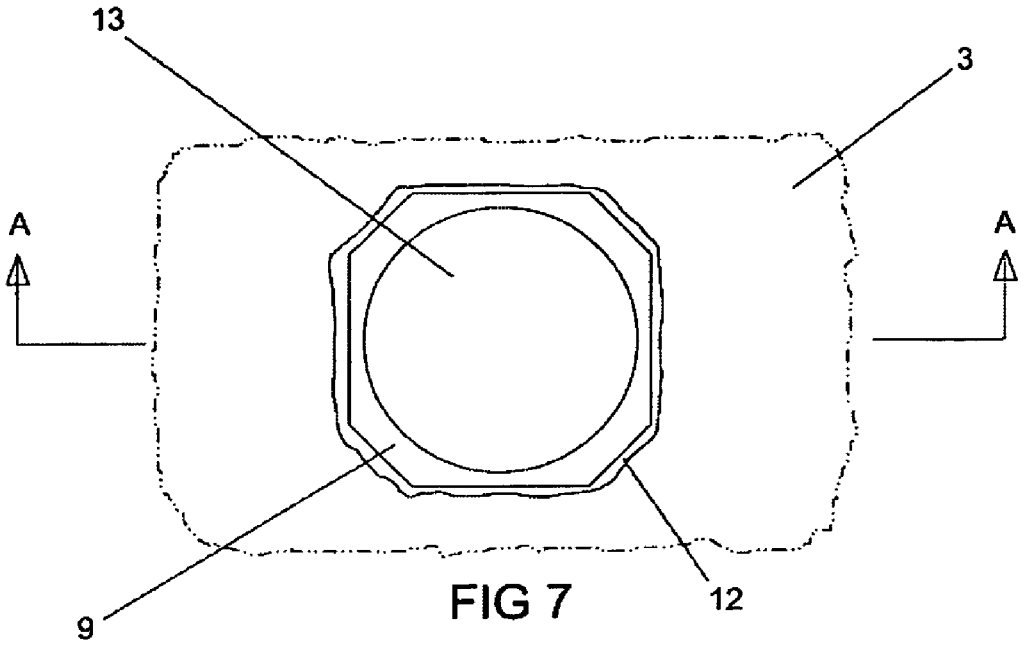
FIG. 7 depicts a top view of the shape of the adhesive layer as adhered to the surface of the sheet metal.
Figure 8:
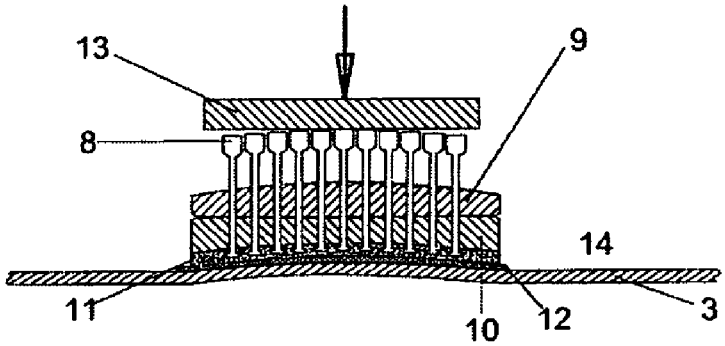
FIG. 8 depicts the tool as depicted in FIG. 6, just prior to use of a flat disc or plate onto head of the pins for flattening the somewhat concave dent to a desired surface.
Figure 9:
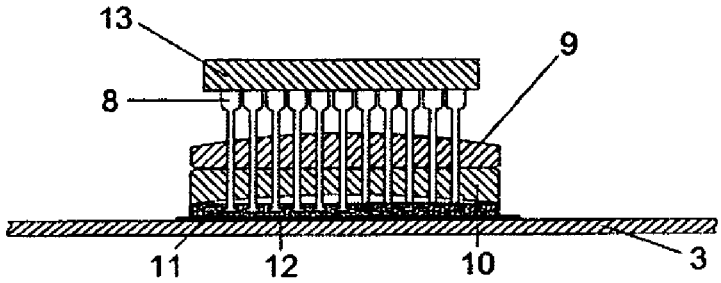
FIG. 9 depicts the tool as depicted in FIG. 8, just after use of the flat disc or plate on the heads of the pins for flattening the somewhat concave dent to the desired surface.

The dent puller tool (1) is placed on either side of the dent puller assembly (2) as shown in FIG. 4 with the wedge-shaped pieces between the top plate (9) and bottom plate (10) as shown in FIG. 5. When the handles (4) and (5) are squeezed together the wedge pieces (6) and (7) move inward separating the top plate (9) and the bottom plate (10) pulling the pins (8), flexible material, and dent upwards towards the surface surrounding the dent. Because the dent is being pulled from the center outward due to the convex shape of the top plate (9) in the reverse manner that created the dent, the force needed is small and the dent puller tool (1) provides easy control of the amount of movement. The handles (4) and (5) are squeezed until the dent that started concaved becomes convex to overcome the dent memory in the metal as shown in FIG. 6. The dent puller tool (1) is then removed form the dent puller assembly (2). If the pins (8) are not perfectly even as shown in FIG. 8 then a flat disk (13) as shown in FIG. 7 can be used to push the pins (8) even as shown in FIG. 9. If individual pins (8) are not even, then a punch (not shown) or hook (not shown) can be used to push or pull the pins (8) even with the other pins (8). If the pins (8) in a row or part of a row are not even, a small block (not shown) can be used to push the pins (8) even. Once all pins (8) are even a release agent can be used to release the dent puller assembly (2) and remove any remaining adhesive (12).

I claim:

1. A dent removal tool comprising:

a lower plate and an upper plate;

said lower plate having a lower side proximate to a dent in a surface to be repaired and an upper side;

said upper plate having a lower side proximate to the upper side of the lower plate and an upper side;

a plurality of pins slidably extending through said lower and upper plates, said pins having heads proximate to said upper side of said upper plate and lower attachment ends adapted for receiving an adhesive; and a displacing member for selectively displacing said upper plate away from said lower plate so that said upper side of said upper plate will push the heads of said pins upwardly as said upper plate is displaced, causing said lower attachment ends to move upwardly.

2. The dent removal tool defined in claim 1, further comprising an adhesive material on said lower attachment ends.

3. The dent removal tool defined in claim 2, wherein said adhesive material on said lower attachment ends is further adhered to said dent.

4. The dent removal tool defined in claim 1, wherein said displacer includes at least one camming surface.

5. The dent removal tool defined in claim 4, wherein said camming surface is a wedging surface disposed near the edges of said lower and upper plates.

6. The dent removal tool defined in claim 4, wherein there are two opposed wedging surfaces disposed respectively near the edges of said lower and upper plates.

7. The dent removal tool defined in claim 6, further comprising a scissors handle operatively connected to said opposed wedging surfaces for forcing them together, thereby to displace said upper plate away from said lower plate.

8. The dent removal tool defined in claim 1, wherein said lower side of said lower plate is at least partially concave.

9. The dent removal tool defined in claim 1, wherein said upper side of said upper plate is at least partially convex.

10. The dent removal tool defined in claim 8, wherein the curvature of said concave lower side of said lower plate is approximately equal to the reverse curvature the dent will take prior to springing back to a substantially smooth surface once force applied by the dent removal tool is removed, taking into account deformation of applied adhesive.

11. The dent removal tool defined in claim 9, wherein the curvature of said convex upper side of said upper plate is approximately equal to the reverse curvature the dent will take prior to springing back to a substantially smooth surface once force applied by the dent removal tool is removed, taking into account deformation of applied adhesive.

12. A method for removing dents from a surface comprising:

providing a tool having a lower plate and an upper plate;

said lower plate having a lower side proximate to a dent in a surface to be repaired and an upper side;

said upper plate having a lower side proximate to the upper side of the lower plate and an upper side;

providing a plurality of pins slidably extending through said lower and upper plates, said pins having heads proximate to said upper side of said upper plate and lower attachment ends adapted for receiving an adhesive; and selectively displacing said upper plate away from said lower plate so that said upper side of said upper plate will push the heads of said pins upwardly as said upper plate is displaced, causing said lower attachment ends to move upwardly.

13. The dent removal tool defined in claim 12, further comprising applying an adhesive material on said lower attachment ends prior to selectively displacing said upper plate away from said lower plate.

14. The dent removal tool defined in claim 13, further comprising applying an adhesive material on said lower attachment ends and further adhering said lower attachment ends to said dent prior to selectively displacing said upper plate away from said lower plate.

15. The dent removal tool defined in claim 1, wherein said selectively displacing is accomplished by camming the upper plate away from the lower plate.

16. The dent removal tool defined in claim 15, wherein said camming is accomplished by wedging the upper plate away from the lower plate.

17. The dent removal tool defined in claim 15, wherein said camming is accomplished by moving two opposed wedging surfaces disposed respectively near the edges of said lower and upper plates toward each other.

18. The dent removal tool defined in claim 17, wherein said two opposed wedging surfaces are moved together by means of a scissors handle.

19. The dent removal tool defined in claim 12, wherein said lower side of said lower plate is at least partially concave.

20. The dent removal tool defined in claim 12, wherein said upper side of said upper plate is at least partially convex.

21. The dent removal tool defined in claim 19, wherein the curvature of said concave lower side of said lower plate is approximately equal to the reverse curvature the dent will take prior to springing back to a substantially smooth surface once force applied by the dent removal tool is removed, taking into account deformation of applied adhesive.

22. The dent removal tool defined in claim 20, wherein the curvature of said convex upper side of said upper plate is approximately equal to the reverse curvature the dent will take prior to springing back to a substantially smooth surface once force applied by the dent removal tool is removed, taking into account deformation of applied adhesive.

* * * * *